US005097730A

United States Patent [19]

Bernard et al.

[11] Patent Number: 5,097,730

[45] Date of Patent: Mar. 24, 1992

[54] INLINE RATCHETING TOOL

[76] Inventors: Oswald J. Bernard, 180 Modern Farms Rd.; Paul E. Bernard, 216 Modern Farms Rd., both of Wagamman, La. 70094; William P. Bernard, 5101 Willow Tree Rd., Marrero, La. 70072

[21] Appl. No.: 608,720

[22] Filed: Nov. 5, 1990

Related U.S. Application Data

[63] Continuation-in-part of Ser. No. 268,178, Nov. 7, 1988, abandoned.

[51] Int. Cl.[5] ..... B25B 13/46

[52] U.S. Cl. ..... 81/57.39; 81/59.1

[58] Field of Search ..... 81/57.39, 59.1

[56] References Cited

U.S. PATENT DOCUMENTS

| | | | |
|---|---|---|---|
| 4,669,338 | 6/1987 | Collins | 81/57.39 |
| 4,674,368 | 6/1987 | Surowiecki | 81/57.39 |
| 4,722,252 | 2/1988 | Fulcher et al. | 81/57.39 |
| 4,819,520 | 4/1989 | Collins | 81/57.39 |

FOREIGN PATENT DOCUMENTS

| | | | |
|---|---|---|---|
| 747709 | 7/1980 | U.S.S.R. | 81/57.39 |
| 8705553 | 9/1987 | World Int. Prop. O. | 81/57.39 |

*Primary Examiner*—James G. Smith

*Attorney, Agent, or Firm*—Pravel, Gambrell, Hewitt, Kimball & Krieger

[57] ABSTRACT

A wrench body pivotally connected to an end of a reciprocating power source, a tool head assembly attached to the opposite end of the reciprocating power source, which would include a tool head, having an aperture for the work piece, tracking arm attached to the tool head and for being matingly slideable into a surface of the wrench body; a retainer ring having at least two retainer grooves; at least two roller drive pins positioned within each of the retainer grooves, and biased away from the retainer rim by a leaf spring inserted between the wall of the rim and each drive pin; a ratcheting gear operative attached to the tool body and positioned in the aperture for connecting the work piece, the ratcheting gear having a plurality of axially aligned and beveled channels along the perimeter of the gear so that one of the drive pins are received into at least one of the channels, in order to achieve the ratcheting function, and through a movement of 15°, the second ratcheting pin is positioned within a channel, for reestablishing the ratcheting motion, while the first pin resumes its position within the retainer groove. A second embodiment would provide a plurality of rollers to particularly define the tracking arm, and a pair of springs to work with the drive pins.

8 Claims, 5 Drawing Sheets

INLINE RATCHETING TOOL

This application is a Continuation-In-Part of the application bearing U.S. Ser. No. 07/268,178, filed in the Patent Office on Nov. 7, 1988, by the same inventors, now abandoned.

BACKGROUND OF THE INVENTION

1. Field of the Invention

The present invention relates to ratcheting tools such as torque wrenches. More particularly, the present invention relates to an improved ratcheting tool having a reduced angle of latchability for use in a confined space 2. General Background In several industries, particularly of the type utilizing structural components which require the tightening down nuts with a very large torque in the magnitude as high as 50,000 foot lbs. in order to create the proper feel in the line. There have consequently been developed a series of type of wrenches known as torque wrenches, which are for the most port hydraulically controlled wrenches, and utilize a type of ratcheting mechanism which is quite common so that the wrench can be hydraulically operated in order to achieve the required high torque, yet on the other hand attempt to operate as with a ratcheting wrench in a more confined area than one would normally be able to undertake.

One of the most recent types that have been developed is disclosed in U.S. Pat. No. 4,669,338, entitled "Ratcheting Box Wrench", wherein there is utilized a standard wrench body connected to a reciprocating power head. There is included a tool head assembly having an aperture which would be placed upon the work piece. The ratcheting mechanism of the wrench would include the ratchet gear having a series of arcuate channels equally spaced around the circumference of the gear, for providing a recess in which a series of roller drive pins are positioned in and out of in order to provide a ratcheting motion. When the roller drive pins are in the arcuate channels there in the drive position for rotating a flange nut. When the tool head assembly is ratcheted back to its original position, all of the drive pins slip into a ratcheting slot of the tool rim and are positioned and held in place for the drive portion of the cycle by one spring located on both sides of the roller drive pins so that the pins move into the ratcheting gear against the bias of the spring attached to the head assembly. Each of the drive pins are located 30° apart, and therefore when the pins are moving from one arcuate slot to the next in order to accomplish the ratcheting function, there is what is called a 30° latchability requirement in that the handle of the tool must move 30° in order to move into the next ratcheting motion. This 30° movement by the handle is a distance which is oftentimes prohibitive in that the handle is in a more confined area, and therefore 30° latchability is undesirable.

There are numerous other patents which have been issued on the subject of torque wrenches, these patents are being provided herewith in te accompanying statement of the art, accompanying this application.

This application is a Continuation-In-Part of an application bearing U.S. Ser. No. 07/268,178, filed Nov. 7, 1988, in the U.S. Patent Office by the same inventors, which provides an inline ratcheting tool having retainer grooves spaced apart at 45° in arcuate channels and a ratcheting gear spaced apart at 30°, with the 45° to 30° crossover allowing a 15° movement of the ratcheting head. That application is incorporated hereunto by reference.

SUMMARY OF THE PRESENT INVENTION

One embodiment of the apparatus of the present invention solves the problem in the art of ratcheting tools, in that there is provided an inline ratcheting tool having a latchability of 15°, and therefore solving the problem of working the tool in a confined area. There is provided a wrench body pivotally connected to an end of a reciprocating power source, a tool head assembly attached to the opposite end of the reciprocating power source, which would include a tool head, having an aperture for the work piece, a solid tracking tool head and for being matingly slidable into a surface of the wrench body; a retainer rim having at least two retainer grooves; at least two roller drive pins positioned within each of the retainer grooves, and each biased away from the retainer rim by a separate leaf spring inserted between the wall of the rim and each drive pin; a ratcheting gear operative attached to the tool body and positioned in the aperture for connecting the work piece, the ratcheting gear having a plurality of axially aligned and beveled channels along the perimeter of the gear so that one o the drive pins are received into at least one of the channels, in order to achieve the ratcheting function, and through a movement of 15°, the second ratcheting pin is positioned within a channel, for reestablishing the ratcheting motion, while the first pin resumes its position within the retainer groove.

In a second embodiment, the apparatus would comprise a channel for guiding the tracking arm, the channel formed by a plurality of rollers along the upper portion of the tracking head, and the outer arcuate wall of the ratcheting gear housing for reducing the friction encountered by the movement of the tracking arm. Furthermore, each of the drive pins are provided with a insert spring protector secured to the interior face of the grooves housing each of the drive pins, with the protector accommodating a pair of coiled springs for exerting force against the wall of each of the drive pins or urging the drive pins out of the groove in engagement with the ratcheting gear, and further providing a means to allow the springs to be coiled by the force of the drive pin being returned into the groove, but to be protected against being crushed by the drive pin within the slot.

It is therefore a principal object of the present invention to provide an inline ratcheting tool having 15° latchability during use;

It is a further object of the present invention to provide an inline ratcheting tool which provides for ratcheting in a confined space, the use of a single drive pin driving the tool between a ratcheting gear and the ratchet tool body; and It is still a further object of the present invention to provide an inline ratcheting tool having retainer grooves spaced apart at 45° in arcuate channels in a ratcheting gear spaced apart at 30°, with the 45° to 30° cross over allowing a 15° movement of the ratcheting head;

It is still a further object of the present invention to provide an inline ratcheting tool wherein one embodiment provides a plurality of roller members to define the upper wall of an arcuate channel in which the tracking arm moves with reduced friction during the ratcheting process;

It is still a further object of the present invention to provide an inline ratcheting tool which allows spring biased drive pins to be forced into the respective drive slots without crushing the spring that would urge them out of the slot during the operation of the ratcheting gear.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
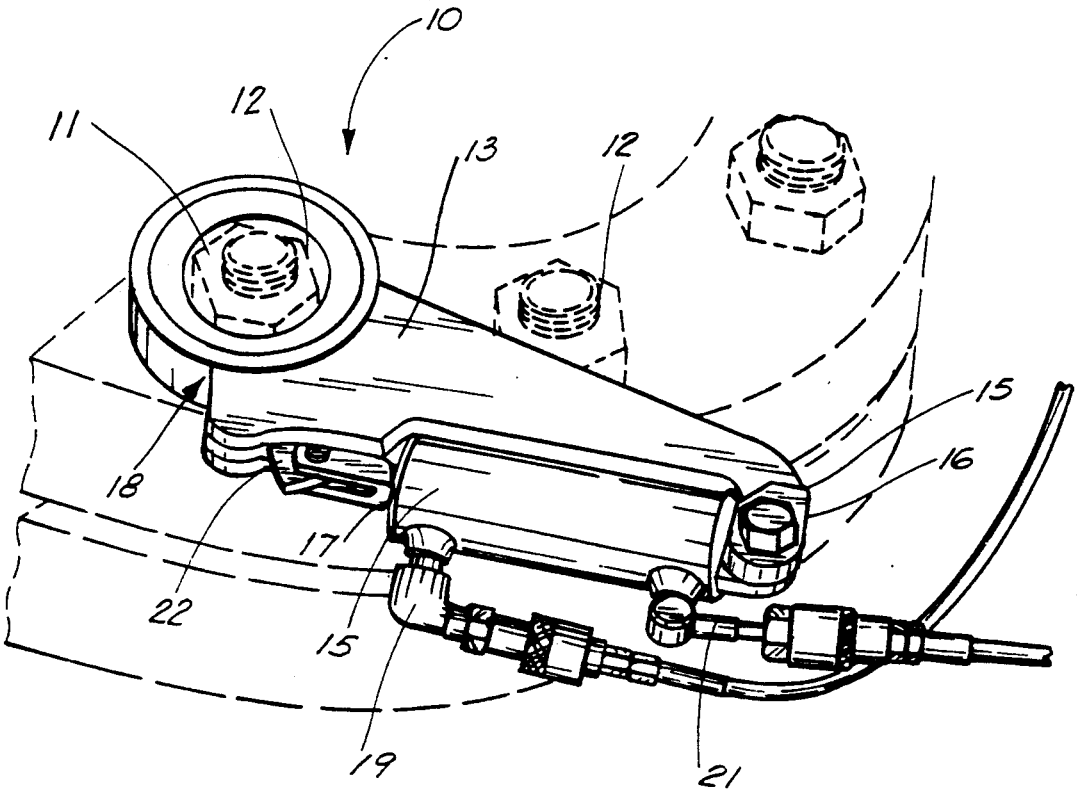
FIG. 1 is an overall view of the apparatus of the present invention.

The first embodiment of the apparatus of the present invention relates to an inline ratcheting tool 10, illustrated in FIG. 1. The inline ratcheting tool 10 is positioned on a head 11 of a nut 12. In operation, the body portion 13 of tool 10 would engage a second nut 12 to provide a base from which the inline ratcheting tool 10 will obtain the necessary leverage in order to operate. As illustrated in FIG. 1, there is further mounted on body portion 13 a hydraulic cylinder 15 having the hydraulic cylinder connectedly engaged at its rear end 15 to the upper body portion 16 of body 13, and the cylinder having a piston member 17 for engaging the ratcheting means 18 (as will be discussed further), so that as the piston moves forward and rearward from the flow of hydraulic fluid in lines 19 and 21, ratcheting means 18 operates to tighten or loosen nut 12.

As is further illustrated in FIG. 1, piston 17 is attached to a tracking head 22, which extends from a tracking rail 24 (FIG. 2) mounted along an arcuate tracking arm 26 attached to the ratcheting means 18.

Turning now to ratcheting means 18, there is provided a circular ratcheting gear housing 28, having a peripheral edge 30, encircling the housing 28, and integrally attached to the tracking arm 26. Gear housing 28 includes a circular enlarged bore 32 which defines an interior bore wall 34 of housing 28. There would be positioned within the bore 32 of housing 28 a circular ratcheting gear 36 of the type having a central cutout portion 38 for accommodating the work piece, such as a nut 12 or the head of a bolt, and the remainder of the gear 36 defining a peripheral surface 40 slidably accommodated within bore 32 of housing 28 along the interior surface 34 of housing 28. Peripheral surface 40 of ratcheting gear 36 contacts interior surface 34 of housing 28 along is circular wall, and would further comprise a plurality of arcuate ratchet channels 42 positioned equally distant apart along the outer peripheral wall 40 of gear 36, there being in the preferred embodiment a total of twelve peripheral ratchet channels 42, each being approximately 30° from center to center. There is further provided upper and lower rings 37 and 39 respectfully, (FIG. 3) attached to the outer walls of body 28, with screws 41 to maintain ratchet gear 36 in position within bore 32.

Figure 3:
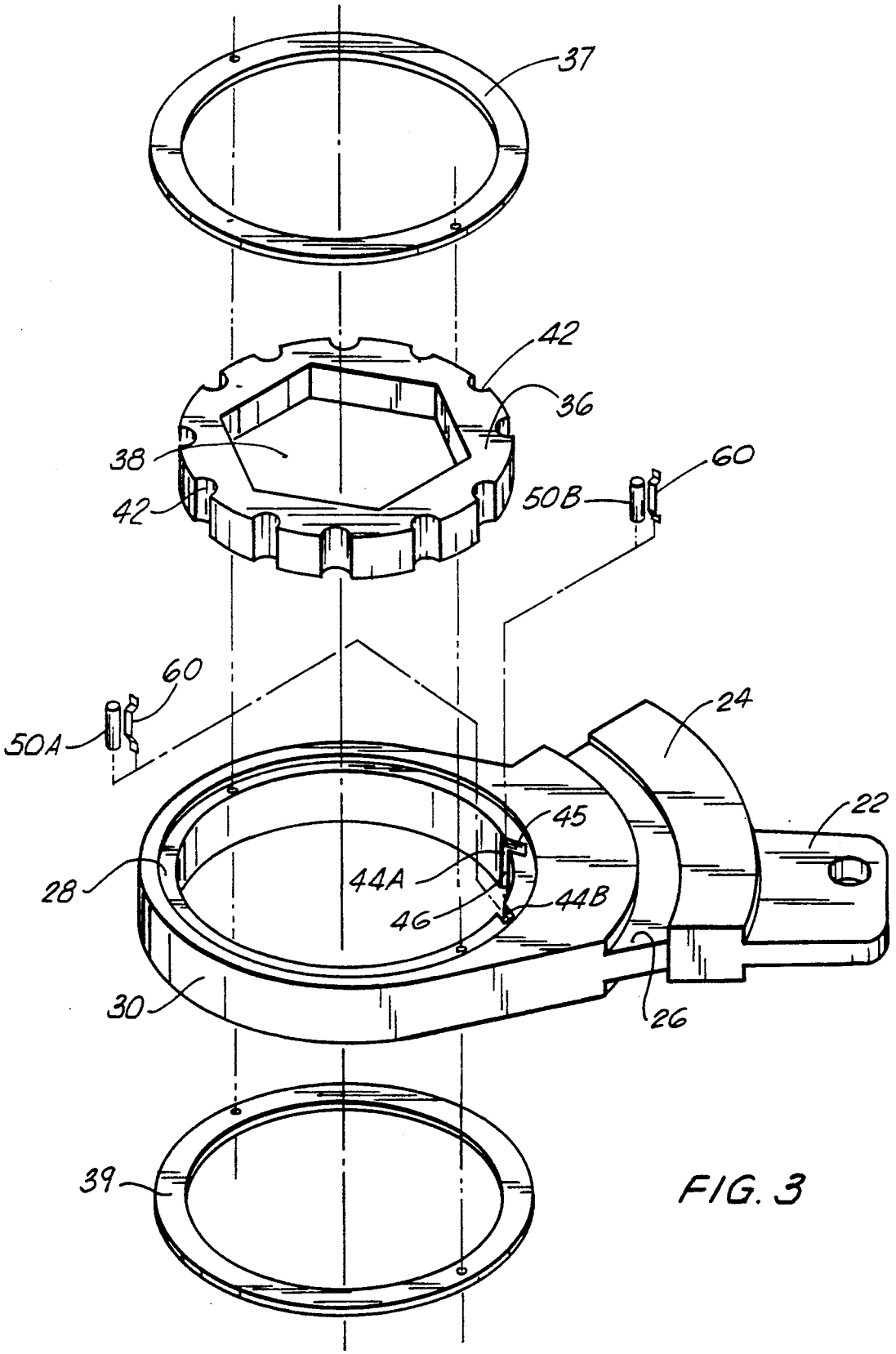
FIG. 3 is an exploded view of the preferred embodiment of the ratcheting portion of the preferred embodiment of the apparatus of the present invention.
Figure 9:
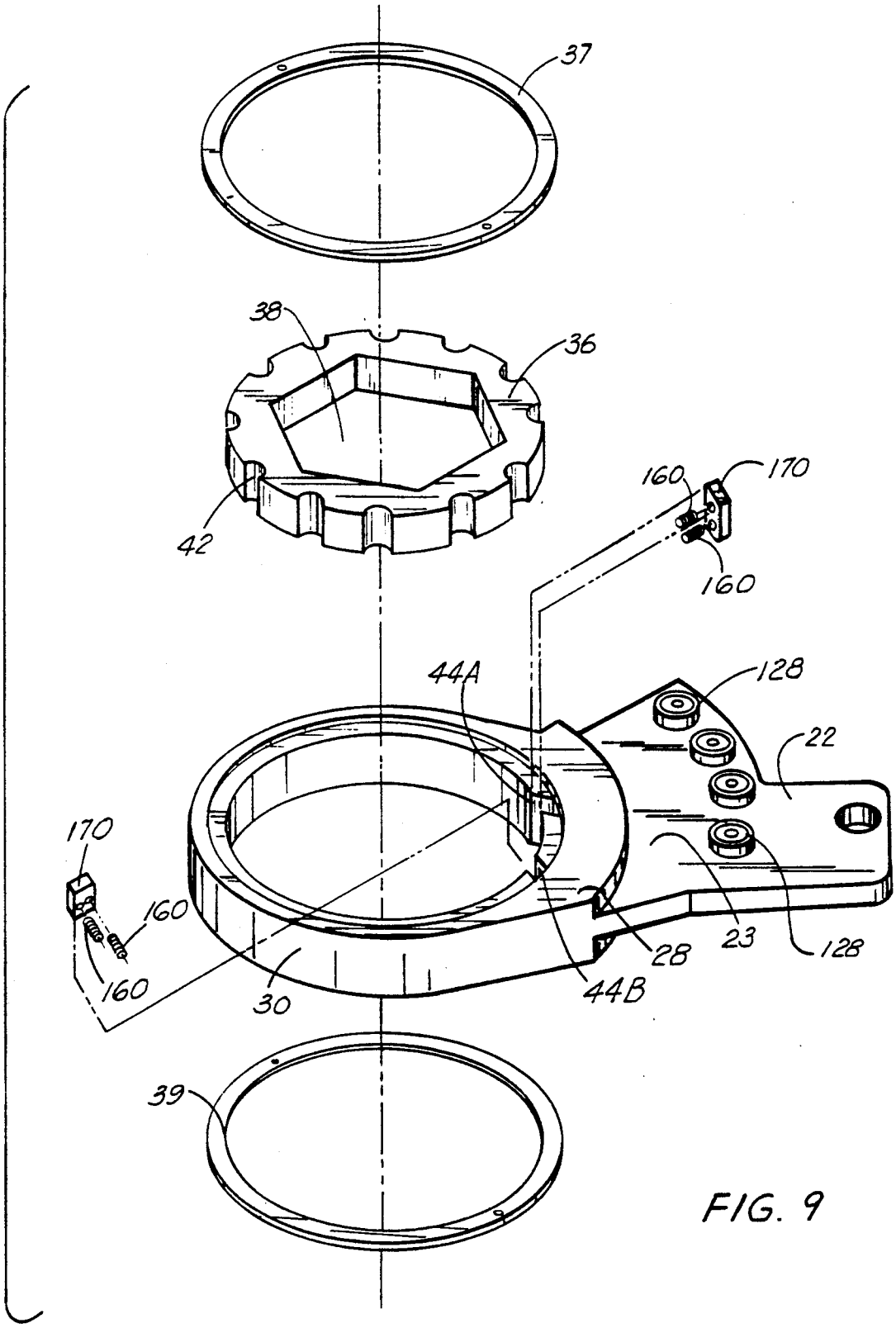
FIG. 9 illustrates an exploded view of the additional embodiment of the apparatus of the present invention.

Ratcheting gear 36 would work in conjunction with body portion 28, in that body portion 28 would include at least two retainer grooves 44A and 44B cut into the body of housing 28, each of the grooves having a parallel sidewall 46, and a flat rear wall 48, for defining the groove space 45 there within. Each of the grooves would be at a depth to accommodate a drive pin 50A aand 50B respectfully, which would be a metallic pin extending within each groove 40A, 40B, and of the same width as the width of body portion 28 as seen in FIG. 3. The drive pins 50A and 50B, would be of a diameter slightly smaller than the width of box of the retainer grooves, so that the drive pins may move in and out of each groove rather easily during use of the ratcheting apparatus.

Figure 2:
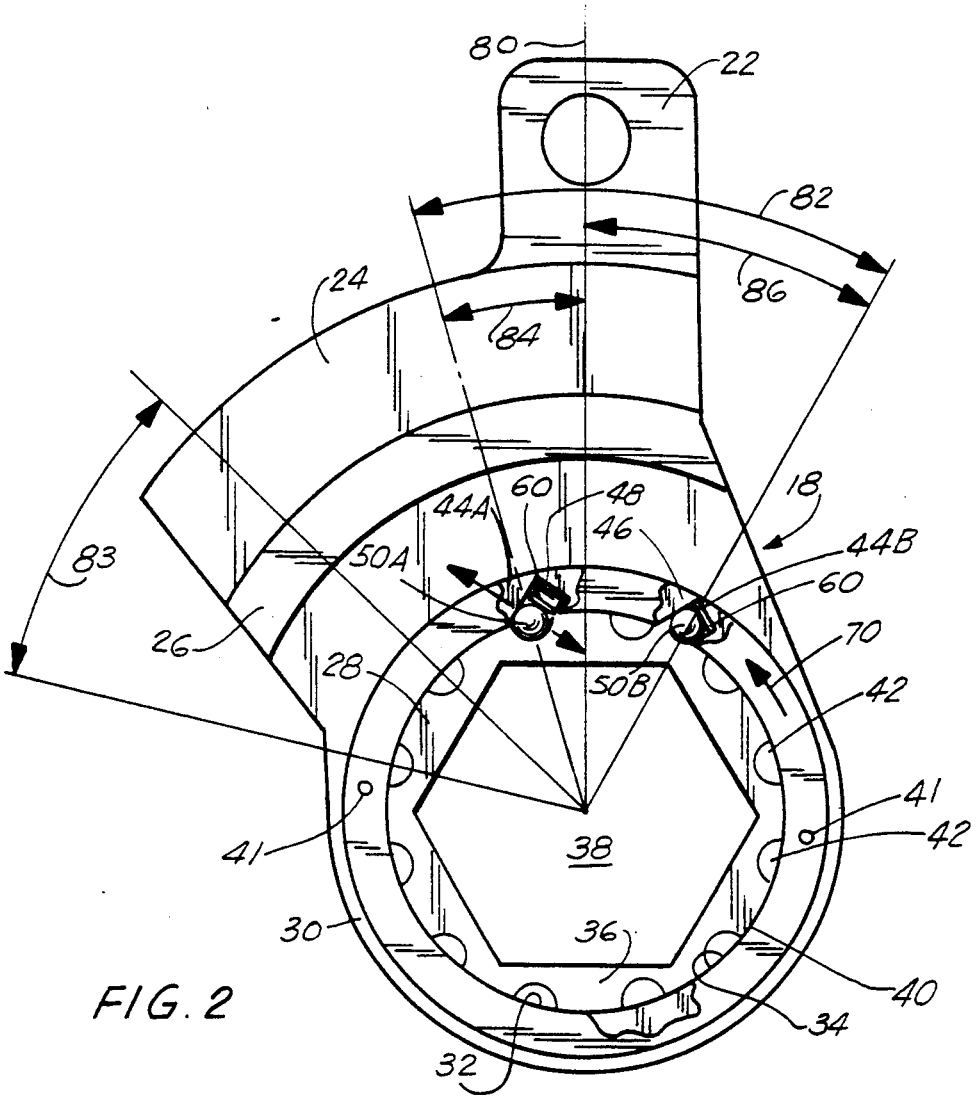
FIG. 2 is a cross sectional view of the preferred embodiment of the apparatus of the present invention.
Figure 4:
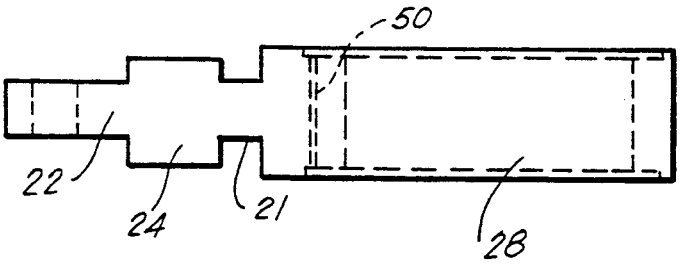
FIG. 4 is a top view of the preferred embodiment of the present invention.
Figure 5:
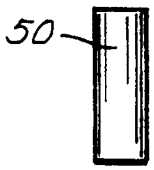
FIG. 5 is a side view of a pin member in the apparatus of the present invention.
Figure 6A:
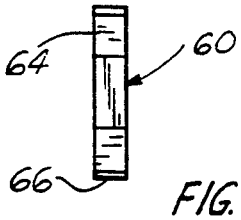
FIGS. 6A and 6B illustrate in top and side view respectively the leaf spring members in the preferred embodiment of the apparatus of the present invention.
Figure 6B:
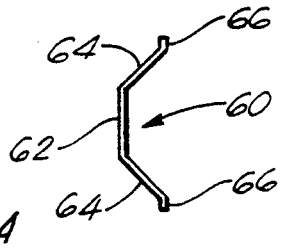

Turning now to the operation of the apparatus, each drive pin 50A, 50B is provided with a spring member 60, which is a type of leaf spring having a flat raised body portion 62 with a pair of flexible arm portions 64 extending from the body portion 62 and having a pair of feet 66, with spring 60 positioned between the rear wall 48 of groove 44 and each drive pin member 50A, 50B so that the drive pin member when fully set within each groove 44A, 44B would be set against the bias of the leaf spring 60, with the leaf spring 60 being in the flattened mode as seen in FIG. 2.

In operation, the manner in which each drive pin would lockingly engage between the ratchet gear 36 and the gear body 28 is illustrated by drive pin 50A (FIG. 1) wherein an arcuate ratchet channel 42 has aligned itself with box groove 44A, and therefore spring 60 would be allowed to flex and move the pin member 50A from its position within the groove 44A, to its position partially set within arcuate channel 42. Therefore the ratchet could move no further due to the fact that the body of pin member 50A is lockingly engaged between gear 36 in relation to the stationary position of body 28. Likewise, when pin 50B is engaged in its ratcheting position, pin 50B is totally confined within second channel 44B and leaf spring 60 has been biased to its flat position as seen in FIG. 1. Pin 50B is held in position within groove 44B by the outer wall 40 of ratchet gear 36, i.e., that portion of the wall 40 intermediate a pair of ratchet channels 42.

As was stated earlier, in the design of the relationship between the gear body 28 and ratchet gear 36, if one were to draw an imaginary vertical line 80 along with the center most point of gear 36, there is a 45° angle 82 between first rectangular retainer groove 44A and second rectangular retainer groove 44B. Further, arrow 83 illustrates the 30° angle relationship between each of the arcuate channels 42 formed in the ratcheting gear, the points of which will be discussed further. Likewise, in the position as seen of the pin members as seen in FIG. 1, when pin member 50A is in the ratcheting mode, the arcuate channel in which pin member 50A is set is approximately 15° from the vertical line 80 as indicated by arrow 84. Likewise, when pin member 50B is simultaneously totally confined within groove 44B the retainer groove 44A is 30° from the vertical line 80 as indicated by the arrow 86. Therefore, as ratchet groove 42 turns in the direction position of arrow 70, ratchet gear 36 will move a distance from the point as is illustrated in FIG. 1, to the position that it will be in directly beneath pin 50B so that pin 50B may slide into the arcuate channel 42 for ratcheting. Therefore that movement will be a movement of 15° and simultaneously pin member 50A will slide out of arcuate channel 42 and will be lockingly engaged within retainer groove 44A while drive pin 50B is in the ratcheting mode. Therefore, during operation each of the pins 50A, 50B alternate in ratcheting function, and as one moves into the ratcheting mode, and the other moves out of the ratcheting mode the ratchet gear has only moved a total of 15° as opposed to the prior art, which requires a movement of at least 30°. Therefore, there is a 100% reduction in the swing of the wrench during use which of course translates into a more efficient wrench which can be used in a much more confined area than there is presently known.

In effect, the drive pin is positioned in each of the retainer grooves with each of the drive pins independently spring biased toward moving into the ratcheting channel as the channel moves into alignment with the retainer groove. The retainer grooves are spaced apart so that only a single drive pin secured within a single retainer groove will effect the ratcheting mechanism and the second drive pin is maintained in the retainer groove. A 45° spaced retainer groove in the tracking head is in relation to a 30° ratcheting gear. Therefore, a 45° to 30° cross over of the two allows that a 15° movement of the head will cause the ratcheting pin to be secured within the ratchet channel. As was stated earlier, this 45° to 30° cross over allowing a 15° movement of the head to effect ratcheting allows the tool to be used in a very confined space, and therefore solves the problems that are confronted in the art.

Furthermore, the use of the "half moon" arcuate channels in the ratcheting gear provides that the forces placed on pin members 50A and 50B are in the direction more towards the center of the ratcheting gear and less as a tangential force along the outer surface of the gear, as found in the prior art which utilized the "tear drop" type channels along the wall of the ratcheting gear. In addition, the wear on the arcuate channel is reduced as opposed to the tear drop channel, and if wear is found, the gear may be reversed so that the force is applied to the other part of the channel.

FIGS. 1 through 6-B illustrated a first embodiment of the present invention by the numeral 10. In FIGS. 7-10B, there is illustrated an additional embodiment of the apparatus, designated by the numeral 110. For purposes of explanation, each embodiment 10 and 110 operate similarly to carry out the task of an in-line ratcheting tool, and therefore, any explanation concerning the general manner in which the tool operates, will be as was discussed in the first embodiment. Therefore, the explanation of the components of the additional embodiment will be identical to the first embodiment and can be clearly seen in FIGS. 1-6B. However, with the improvements in the system, as illustrated by the FIGS. 7-10B, the components which comprise these improvements will be discussed, and will be designated as such. If any part is not designated in the new embodiment, it is due to the fact that that part is discussed in the first embodiment and is present in the additional embodiment a well.

Figure 7:
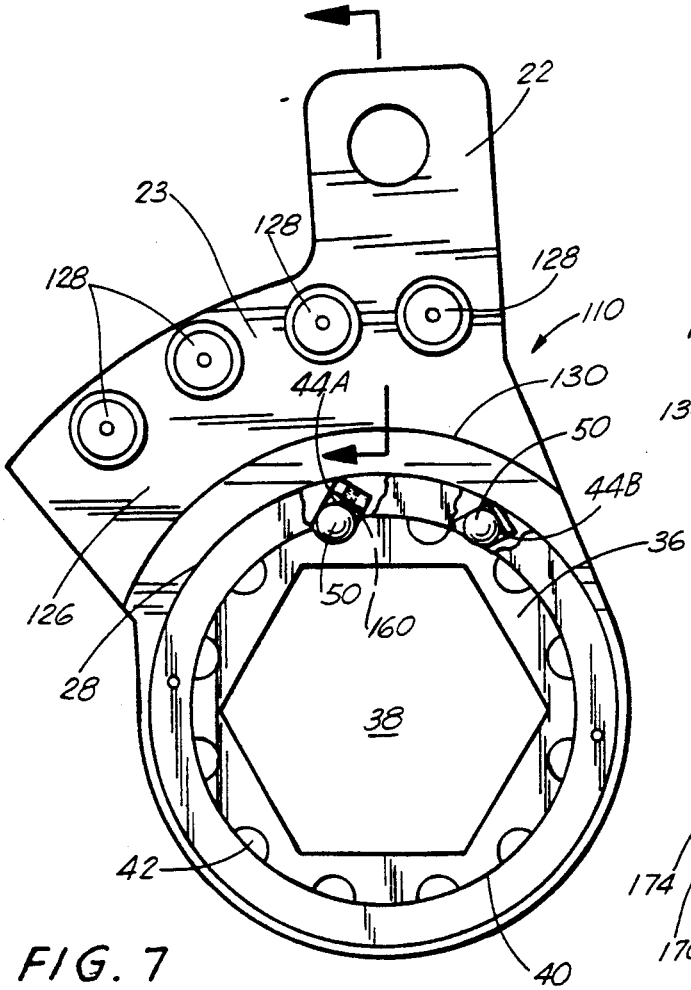
FIG. 7 illustrates a side view of an additional embodiment of the apparatus of the present invention.

Initially, as seen in FIG. 7, there is provided the tracking head 22, which extends into an enlarged body portion 23, and eliminates the fixed tracking rail 24. In the first embodiment, the tracking arm moves within an arcuate channel 26 defined by the tracking rail 24 above and the ratcheting gear housing 18 below to define traveling channel 26. However, in this additional embodiment, as illustrated in FIG. 7, an arcuate tracking arm 126 is defined by a plurality of rollers 128, spaced apart in an arcuate fashion along the length of the body 23 of tracking head 22, for defining a continuous upper surface upon which the tracking member can engage while travelling along. As illustrated, particularly in FIG. 8, the rollers 128 are positioned on either face of the tracking rail 24, and are free rolling members, each pair of rollers 128 on each side of the rail 24 supported by a single axle member 129 extending through the rail 24, and supporting a roller 128 at each end.

Figure 8:
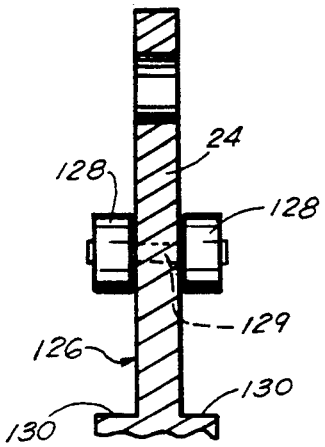
FIG. 8 illustrates an isolated end view of the tracking head of the additional embodiment of the present invention.

The lower face of the arm 126, as with the principal embodiment, is defined by the upper wall 130 of the ratcheting gear housing 18 as illustrated. Therefore, as seen in FIG. 8, in end view, the upper plurality of rollers 128 and the lower ratcheting gear housing 28 to define the arcuate tracking arm 126 on the tracking rail 24 to accommodate the travelling of the body member therethrough during operation of the tool. The plurality of rollers 128 provide a means to reduce the friction between the movement of the body member traveling along the arcuate arm 126, and provides a great improvement in the overall operation of the wrench. Likewise, the rollers 128 are able to withstand the same amount of force as the tracking rail 24 in the first embodiment.

Figure 10A:
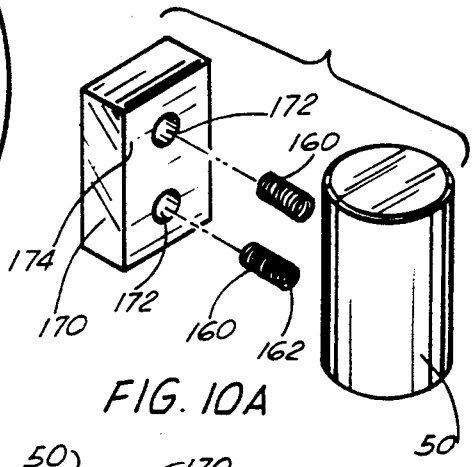
FIGS. 10A–10C illustrate isolated views of the drive pin mechanism in the additional embodiment of the apparatus of the present invention.
Figure 10B:
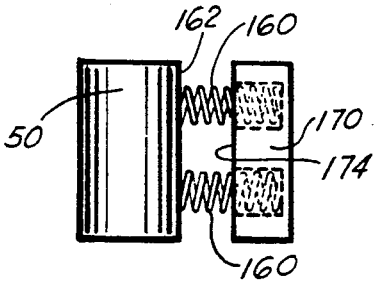
Figure 10C:
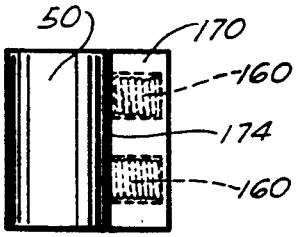

Reference is now made to FIGS. 10A through 10C which illustrate yet another important improvement over the first embodiment of the present invention. In the first embodiment, the drive pins 50 were housed in grooves 44A and 44B, and there was further provided a leaf spring 60 positioned at the base of each groove which served to urge each drive pin 50 into engagement with a ratchet channel 42, when the channel aligned with the respective drive pin 50. However, the leaf springs are limited, in that their ability to retain memory becomes reduced over time, so therefore the urging of the drive pins 50 into engagement is reduced.

In the additional embodiment as illustrated in FIGS. 10A-10C, the leaf spring has been replaced with a combination of elements to solve several problems encountered in the first embodiment. As illustrated, the leaf spring 60 has been replaced by a pair of coil springs 160, each pair positioned at the base of each of the grooves 44A and 44B, and making contact along the length of each drive pin 50, and, like the leaf spring, urging the drive pins 50 out of the channels for engagement with the ratchet channel 42 during operation.

However, it is known that when the drive pins 50 are forced to retract into the grooves, by the outer wall of the ratcheting gear 36, as seen in FIG. 7, the coil spring 160 may be required to coil or "crush" into a configuration that would reduce or perhaps eliminate its ability to recoil. Therefore, as illustrated, there is provided, secured to the base of each channel 44A, 44B, a retainer body 170, having a pair of bores 172 therethrough, each bore 172 of slightly greater diameter than the diameter of the spring 160, and accommodating each spring 160 therein. The thickness of each of the retainer bodies 170 is of a thickness so that, when springs 160 are extended (FIG. 10B), the outer end 162 of each spring 160 extends past the outer face 174 of each retainer body 170, and exerts force upon the drive pin 50, to position the pin 50 into driving engagement on the ratcheting gear 36, as seen in FIG. 10-B. However, when the pin 50 is required to retract into the groove 44 (FIG. 10C), the pin 50 can only retract the distance until it makes contact with the outer face 174 of the retainer body 170. This manner of preventing the pin 50 from retracting any further, allows the springs 160 to coil against the movement of the pin 50, but, only to a certain extent. Therefore, the springs 160 are coiled within the bores 172 of the bodies 170, but are protected from being crushed by the pins 50. This, naturally, greatly increases the life of the springs 160, and allows the pins 50 to move within the grooves 44A, 44B more uniformly to insure proper contact with the ratcheting gear 36 during operation of the tool.

It should be noted that to compensate for the thickness of each retainer body 170, each groove 44A, 44B would have to be channeled out slightly deeper than with the first embodiment so that the drive pins 50 can be fully accommodated within the grooves.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An inline ratcheting tool, comprising:

a) a tool body;

b) a ratcheting head assembly supported on the tool body for engaging a work piece to be loosened or tightened, the ratcheting head assembly further comprising:

i. a tracking rail;

ii. a tracking arm, formed in the tracking rail, and defined in part by a plurality of roller members for providing easier movement of the tracking arm during movement of the tool body;

iii. a retainer ring secured to the tracking rail, having a bore therethrough, and having at least first and second grooves in the wall of the retainer ring;

iv. a ratcheting member positioned within the bore of the retainer ring, the ratcheting member further comprising a plurality of arcuate ratchet channels, each of the channels positioned along the periphery of the ratcheting member, and open ended to an inner wall of the retainer ring; and v. a drive pin positioned in each of the grooves, each of the drive pins independently spring biased toward movement into a ratcheting channel as a channel moves into alignment with a retainer groove; the retainer grooves being spaced apart so that only a firstdrive pin secured within a retainer groove will effect the ratcheting mechanism.

2. The inline ratcheting tool in claim 1, wherein during ratcheting a second drive pin is maintained in the retainer groove.

3. The inline ratcheting tool in claim 1, wherein the retainer grooves are spaced 45° apart in the tracking head in relation to 30° spaced apart ratchet channels in the ratcheting gear, resulting in a 30° cross over between the retainer grooves and the ratchet channels in the ratcheting gear.

4. The inline ratcheting tool in claim 3, wherein the 45° to 30° cross over allows a 15° movement of the head causing the ratcheting pin to be secured within the ratchet channel.

5. The inline ratcheting tool in claim 1, wherein the ratcheting tool is operated under hydraulic power.

6. The inline ratcheting tool in claim 1, wherein the ratcheting tool has a latchability of 15° and an therefore be operated in a confined area.

7. The inline ratcheting tool in claim 1, wherein there is further provided a retainer plate positioned in each of the drive pin grooves for protecting against the coiling of the spring when the drive pins return into the channel following the driving function.

8. An improved inline ratcheting tool of the type having a wrench body, a ratcheting head assembly supported on the wrench body for engaging a work piece to be loosened or tightened, a ratcheting gear positioned within the ratcheting head assembly operable by drive pins driving the ratcheting gear in relation to the ratcheting head assembly, the improvement comprising:

a) a tracking arm positioned on the ratcheting head assembly, the arm further defined by a plurality of free rollers to reduce the friction as the tool undertakes the ratcheting process;

b) spring members positioned in relation to the drive pins for biasing the drive pins into engagement with the ratchet gear; and c) retainer blocks housing the spring members so that as the spring members are compressed by the drive pins, the blocks prevent the drive pins from compressing the springs down to their complete compression tolerance.

* * * * *